US005967868A

United States Patent [19]

Ito et al.

[11] Patent Number: 5,967,868

[45] Date of Patent: Oct. 19, 1999

[54] WATER JET PROPULSION UNIT MOUNTING STRUCTURE

[75] Inventors: Kazumasa Ito; Hiroji Kato, both of Hamamatsu, Japan

[73] Assignee: Yamaha Hatsudoki Kabushiki Kaisha, Iwata, Japan

[21] Appl. No.: 08/341,455

[22] Filed: Nov. 17, 1994

Related U.S. Application Data

[63] Continuation of application No. 07/683,597, Apr. 9, 1991, abandoned.

[30] Foreign Application Priority Data

Apr. 10, 1990 [JP] Japan ..... 2-94631

[51] Int. Cl.[6] ..... B63H 11/00

[52] U.S. Cl. ..... 440/111; 440/38; 440/47; 440/52

[58] Field of Search ..... 114/270; 440/38, 440/39, 40, 41, 42, 43, 46, 47, 52, 111, 112

[56] References Cited

U.S. PATENT DOCUMENTS

| | | | |
|---|---|---|---|
| 3,040,696 | 6/1962 | Dahle | 440/46 |
| 3,233,573 | 2/1966 | Hamilton | 440/39 |
| 3,248,876 | 5/1966 | Parsons | 440/41 |
| 3,405,526 | 10/1968 | Aschauer | 440/47 |
| 3,827,392 | 8/1974 | Jones | 114/270 |
| 3,845,923 | 11/1974 | Atkinson | 440/52 |
| 3,868,833 | 3/1975 | Noe et al. | 440/38 |
| 4,239,013 | 12/1980 | Haynes | 440/40 |
| 4,583,953 | 4/1986 | Nakase | 440/52 |
| 4,722,707 | 2/1988 | Murase | 440/38 |
| 4,765,075 | 8/1988 | Nakase et al. | 440/111 |
| 4,813,898 | 3/1989 | Nakase et al. . | |
| 4,925,408 | 5/1990 | Webb et al. | 114/270 |

FOREIGN PATENT DOCUMENTS

| | | | |
|---|---|---|---|
| 853715 | 10/1952 | Germany | 440/52 |
| 62225492 | of 0000 | Japan . | |
| 1159396 | 7/1969 | United Kingdom | 440/43 |

*Primary Examiner*—Thomas J. Brahan
*Attorney, Agent, or Firm*—Knobbe, Martens, Olson & Bear LLP

[57] ABSTRACT

A jet drive unit is mounted within a jet propelled watercraft in a fashion which prevents vibrations due to the operation of the craft's impeller system from transmitting to the hull. The power transmitting shaft system connecting the water jet unit impeller with the craft's engine is made through an elastic, vibration dampening coupling. Further, the water jet unit casing is mounted to the hull through a plurality of vibration insulating connector assemblies. Thus undesirable hull vibration, and its accompanying noise, may be eliminated.

14 Claims, 10 Drawing Sheets

WATER JET PROPULSION UNIT MOUNTING STRUCTURE

This application is a continuation of application Ser. No. 07/683,597, filed Apr. 9, 1991, now abandoned.

BACKGROUND OF THE INVENTION

This invention relates to a water jet propelling vessel and more particularly to an improved arrangement for mounting and operating the jet propulsion unit of such a vessel.

One popular form of watercraft is that of the jet propulsion type. This type of watercraft generally has a hull that is formed with a longitudinally extending tunnel in the rear portion of the hull. A jet propulsion unit, consisting of an outer housing that defines a water inlet, an impeller housing in which an impeller is supported and a discharge nozzle are supported within the tunnel. The impeller is driven by an engine that is positioned forwardly in the watercraft by means of an impeller shaft that extends through the tunnel to the jet propulsion unit. Although this type of vessel has a number of advantages, the mounting of the jet propulsion unit rearwardly of the driving engine can present some difficulties.

One particular problem with this type of unit stems from the usual mounting arrangement, whereby the jet propulsion unit is mounted rigidly to the vessel's hull. Vibrations of the impeller, transmitted from the engine via the impeller shaft, or due to imperfect balancing of the impeller assembly, or caused by the flow of water, are often transmitted to the hull. Such hull vibrations can be noisy and discomforting to a rider.

It is, therefore, a principal object of this invention to provide an improved water jet propelling vessel and an arrangement for mounting and driving the jet propulsion unit in the hull of the watercraft.

It is another object of this invention to prevent vibration transmission from the jet propulsion unit to the hull of the watercraft.

SUMMARY OF THE INVENTION

This invention is adapted to be embodied in a jet propelled watercraft that has a hull which defines an engine compartment and a recess that is formed in the hull rearwardly of the engine compartment and is adapted to contain the jet drive unit. A prominent feature of this invention lies in the water jet propulsion unit mounting structure for use in such a watercraft. An engine output shaft is coupled, by way of an elastic connection, to an input end of a power transmitting shaft system, which supplies power to a water jet unit impeller. A water jet unit casing member, employed for containing the water jet unit, is attached to various sections of the hull of the watercraft by way of several vibration insulating connector assemblies.

DETAILED DESCRIPTION OF THE PREFERRED EMBODIMENTS

Figure 1:
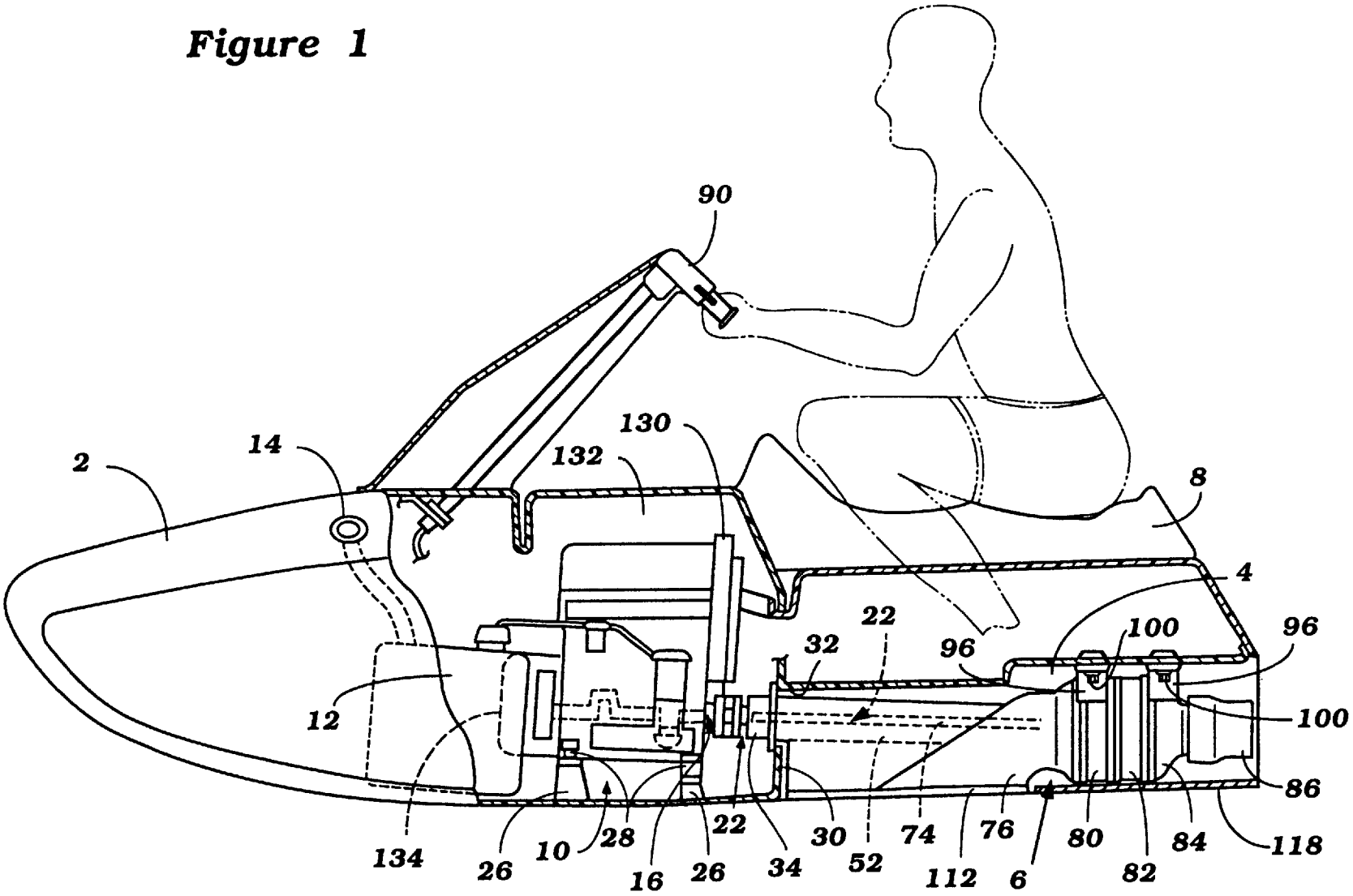
FIG. 1 is a side elevational view, partially broken away, of a jet driven watercraft constructed in accordance with a first embodiment of this invention.

Referring now in detail to the drawings, a small watercraft constructed in accordance with an embodiment of the invention is depicted generally in FIG. 1. In the illustrated embodiment, the watercraft is of the type that is designed to be operated by a single rider sitting in straddle fashion on the watercraft. Although the invention has particular utility in conjunction with such types of watercraft, it is to be understood that the invention can be utilized with other types of jet propelled watercraft than that illustrated.

The watercraft is comprised of a hull, indicated generally by the reference numeral 2, and which may be formed from fiberglass reinforced molded resin, or the like. The hull 2 is formed at its rearward end with a tunnel 4. A water jet unit, indicated generally by the reference numeral 6, is positioned within the tunnel 4 beneath the hull 2.

A rider's area such as a seat 8 is positioned on the hull 2 over the tunnel 4 and is adapted to accommodate a single rider, shown in phantom in FIG. 1, seated in a straddle fashion.

Forwardly of the seat 8, and within an opening formed at the forward portion of the hull 2, there is provided an internal combustion engine, indicated generally by the reference numeral 10, for powering the watercraft. It should be noted that it is desirable to position the engine 10 at a forward location so as to insure good balance of the watercraft. In addition, the engine should be positioned in an area where it will not encroach on the rider's area.

A fuel tank 12 is positioned in the hull 2 forwardly of the engine, and may receive fuel via fill opening 14.

The engine 10 may be of any known type, for example, a two cylinder, in-line crankcase compression, two cycle type. The engine has an output shaft 16 (FIG. 3) that is rotatably journaled and has at its rearwardly projecting exposed end a coupling portion 18. The coupling portion 18 is connected to a similar input coupling member 20 that is affixed to a power transmitting shaft system 22 by means including a rubber coupling member 24 for shock absorption.

As illustrated in FIG. 1, the hull 2 is provided with a plurality of spaced engine supports 26 upon which the engine 10 is mounted by means of vibration insulating blocks 28. In this way, the transmission of vibrations from the engine 10 to the hull 2 is reduced.

Figure 2:
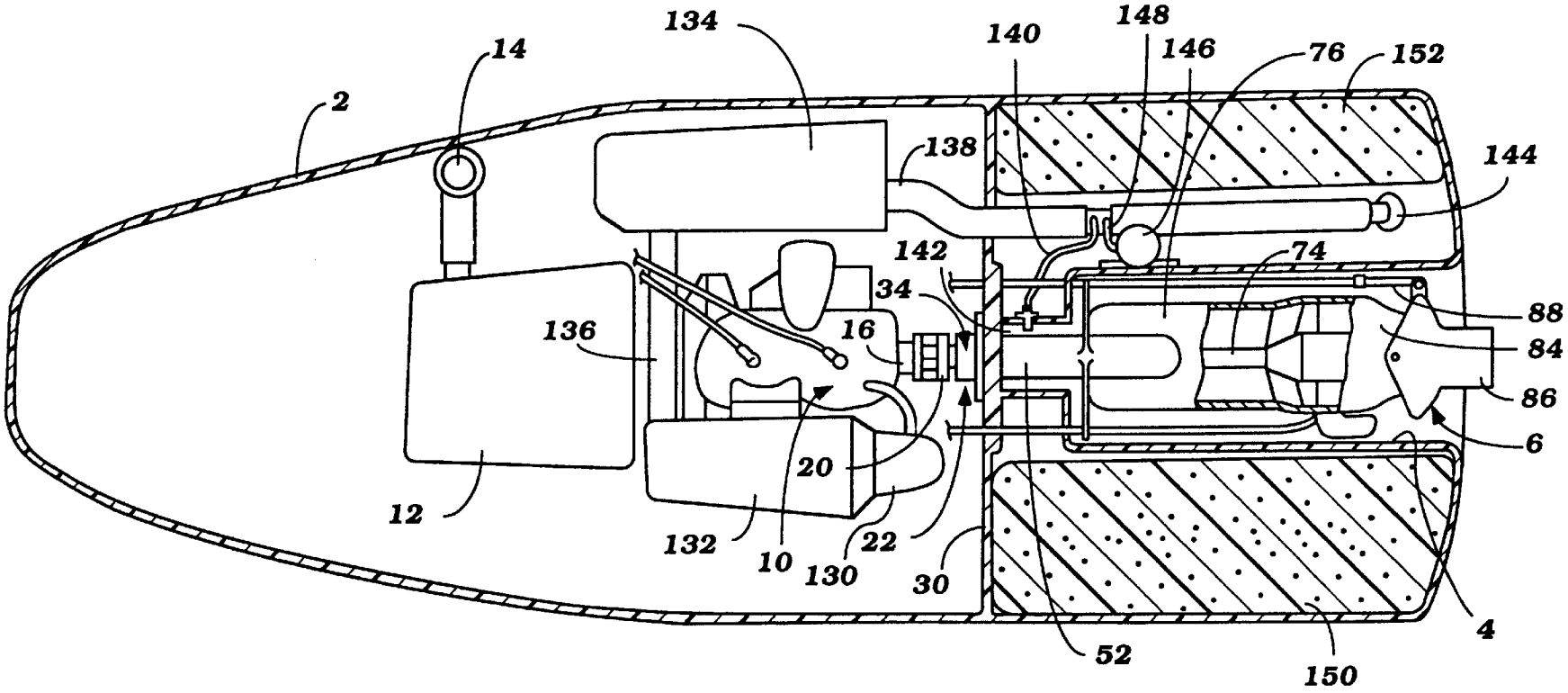
FIG. 2 is a top plan view, partially broken away, of the water craft with the hull shown in cross section.
Figure 3:
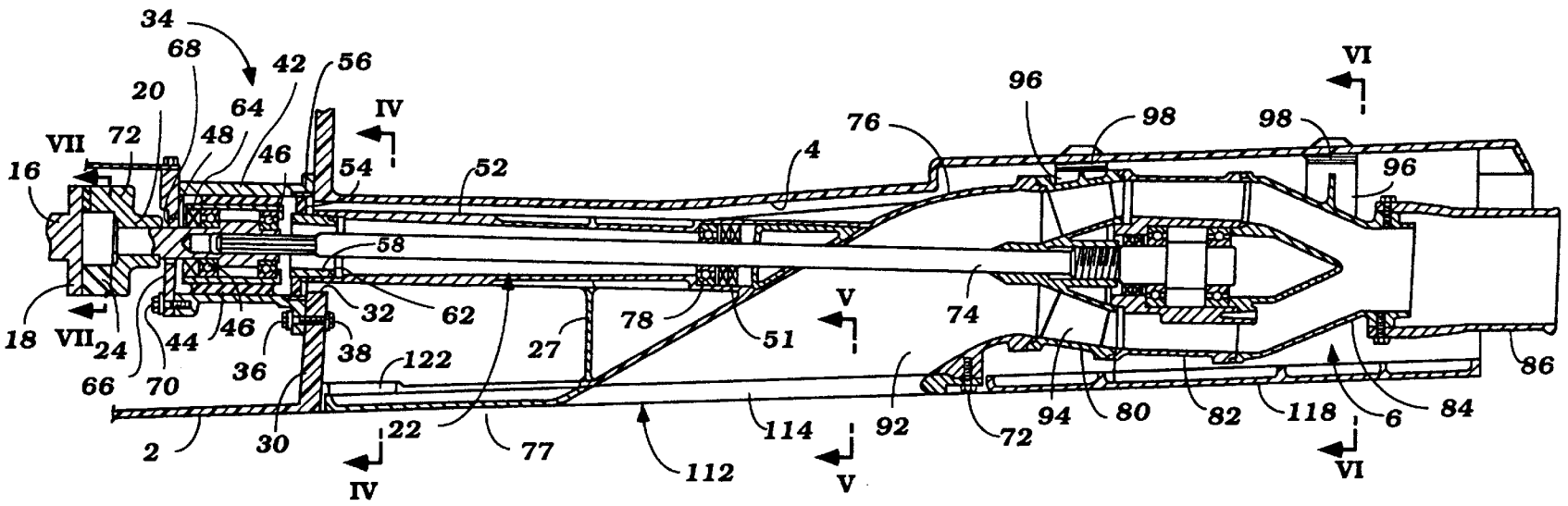
FIG. 3 is a vertical cross sectional view taken through the jet propulsion unit and drive therefore.
Figure 4:
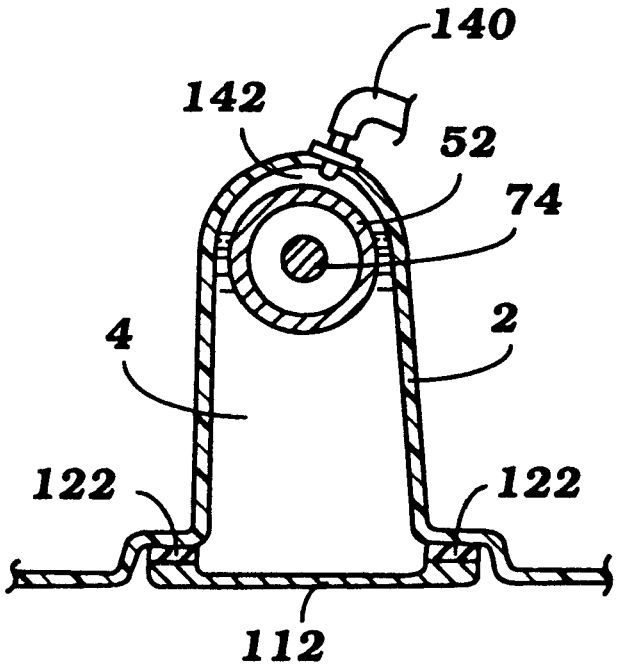
FIG. 4 is a sectional view taken along the line IV—IV of FIG. 3.
Figure 5:
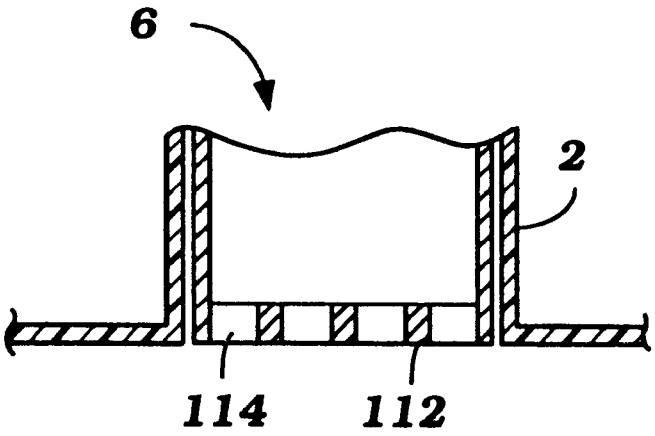
FIG. 5 is a sectional view taken along the line V—V of FIG. 3.

Referring now additionally to FIGS. 2 and 3, the engine compartment is separated from the tunnel 4 by a generally vertically extending bulkhead 30 that is formed integrally with the hull 2. This bulkhead is provided with an opening 32. A bearing carrier, indicated generally by the reference numeral 34, is affixed to the bulkhead 30 by means of threaded fasteners 36 and 38. The bearing carrier 34 includes a bearing carrier inner case 40 and a bearing carrier outer case 42 which are separated by an interposed vibration insulator member 44. The bearing carrier 34 carries a pair of spaced anti-friction bearings 46 which rotatably journal the input shaft 48 and a portion of the power transmitting shaft 22. The water jet unit 6 includes a supporting tube 52 that extends through the bulkhead opening 32 and an elastomeric water seal 54 which extends around this and is held in place by a sleeve 56 that is pressed into the bearing carrier outer case 42. The elastomeric water seal 54 engages a bushing 58 that is pressed to the interior of the supporting tube 52 as by way of an O-ring 62. A seal 64 is also provided forwardly of the forwardmost bearing 46. Adjacent to, and positioned forwardly of, the seal member 64 is a plate member 66 with an opening 68 therein through which input shaft 48 passes. Plate member 66 is secured against the bearing carrier 34 assembly by means of a threaded fastener 70.

Figure 7:
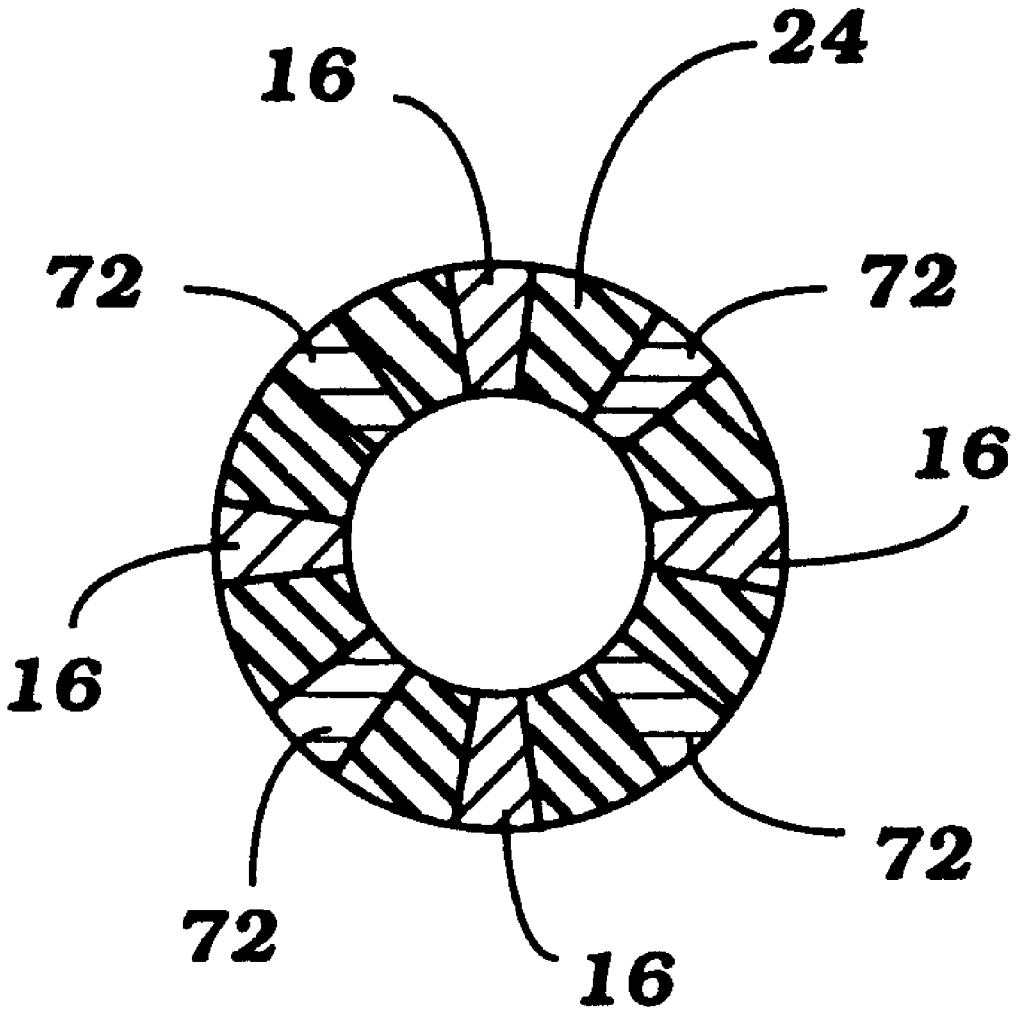
FIG. 7 is a sectional view taken along the line VII—VII of FIG. 3.

Now the coupling assembly between the engine output shaft 16 and the input coupling member 20 will be described in more detail, particularly with reference to FIGS. 3 and 7. As shown in FIG. 3, engine output shaft 16 and input coupling member 20 are adjoined by way of an elastic, shock absorbing rubber coupling member 24. FIG. 7 shows an exemplary configuration of this coupling by way of a sectional view taken along the line VII—VII of FIG. 3. A portion of rubber coupling member 24 is interposed between an extended portion of input coupling member 20, specifically depicted by the reference numeral 72, and a portion of the engine output shaft 16.

The embodiment of FIG. 3 shows the supporting tube 52 which surrounds a portion of the impeller shaft 74 from a location slightly rearward of the bearing carrier assembly 34 and extending rearwardly to the water inlet housing portion 76 of the jet unit casing assembly. An anti-friction bearing 78 rotatably journals, and supports, the impeller shaft 74 within the supporting tube 52 at a location slightly forward of the water inlet housing portion 76. Adjacent to, and rearwardly of, the bearing 78, a pair of seals 51 are provided to ensure water tightness in the region between the bearing 78 and the bearings 46 within the bearing carrier assembly 34.

The water jet unit 6 is provided with a water inlet housing portion 76 and several sectional members (members 80, 82, and 84), and a pivotal discharge nozzle 86. The nozzle 86 is steered by means of a tiller mechanism 88 (FIG. 2), which, in turn, is controlled by the rider via the handlebar assembly 90 (FIG. 1) and appropriate linkages (not shown) in a known manner.

The water inlet housing portion 76 is provided with an inlet opening 92 through which water is drawn from the body of water in which the watercraft is operated. An impeller 94 is contained within the second section 80 of the casing assembly. The impeller 94 is employed to draw water through the inlet opening 92 and to subsequently discharge it through the discharge nozzle 96, in a known manner.

In the embodiment of FIG. 3 the casing assembly is secured, at its second 80 and rear 84 sections, to portions of the hull 2 above the casing section members. Specifically, mounting legs 96, attached to the hull 2 through vibration insulator members 98, extend downwardly, and are formed integrally with, or alternatively are attached to, the casing section members 80 and 84. Thus, the entire casing assembly is suspended, via vibration dampening connections, from the hull 2 within the tunnel 4.

Figure 6:
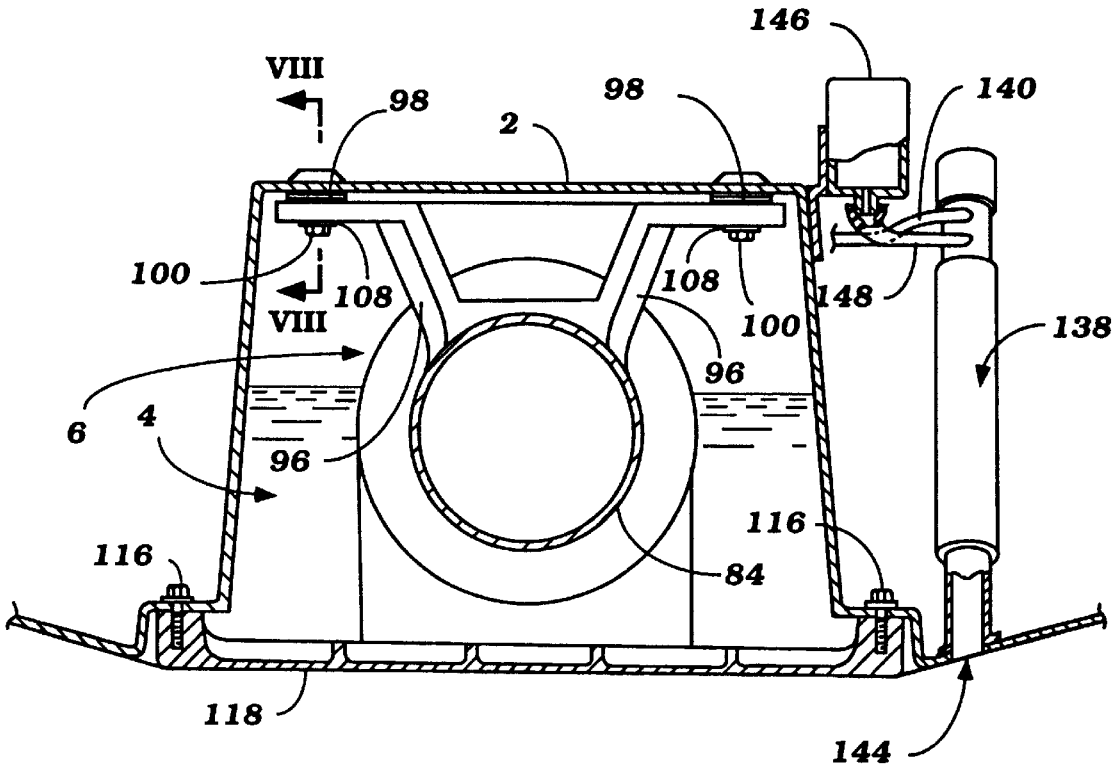
FIG. 6 is a sectional view taken along the line VI—VI of FIG. 3.
Figure 8:
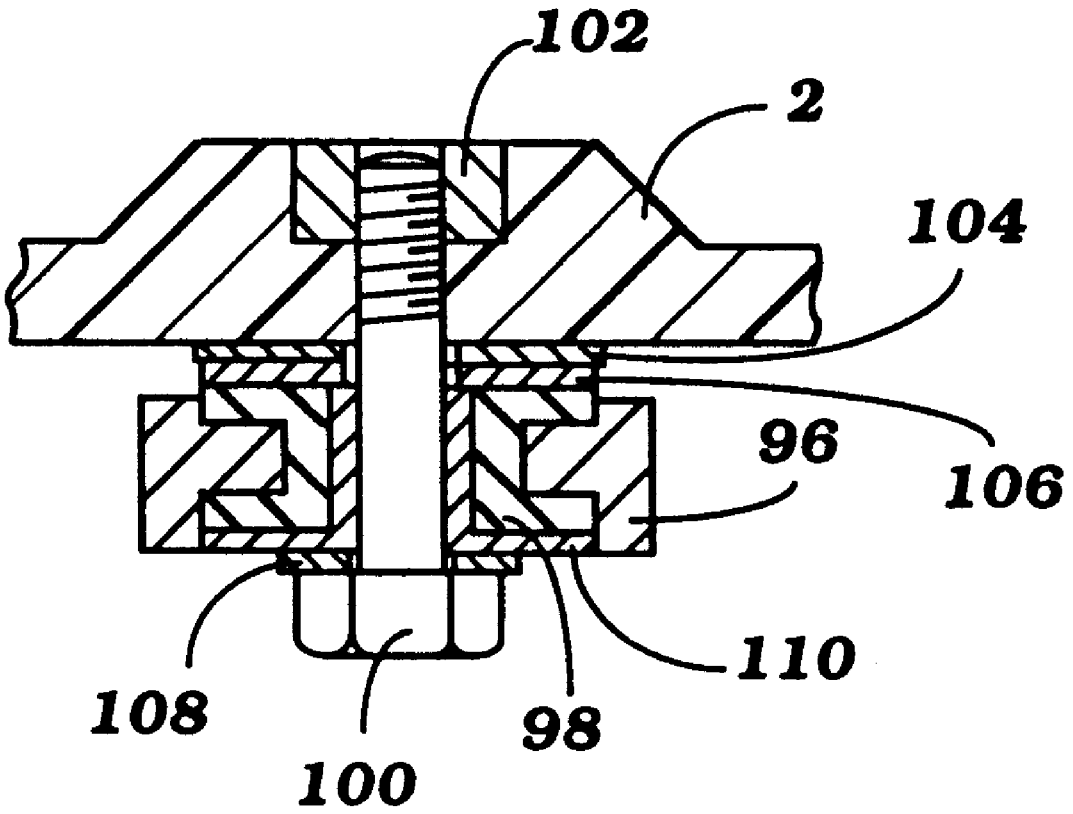
FIG. 8 is a sectional view taken along the line VIII—VIII of FIG. 6.

FIG. 6 further illustrates this arrangement. The sectional view of FIG. 8, taken along the line VIII-VIII of FIG. 6, shows in detail the vibration insulating connections, just discussed. These connector assemblies comprise a vibration dampening insulator member 98 interposed between a portion of a mounting leg 96 and a threaded fastener 100. The threaded fastener 100 secures the vibration insulator member 98 and the mounting leg 96 against the hull 2 by way of its reception into a threaded fastener receiver 102 mounted within the hull 2. Washers 104, 106 and 108 may further be utilized in forming a secure connection and maintaining the desired alignment position of the impeller assembly within the tunnel 4, as shown. Additionally, a washer sleeve 110 may be positioned between the vibration insulator member 98 and the shaft of the threaded fastener 100 to provide rigid support therebetween.

As shown in FIGS. 1, 3, 4 and 5 an inlet plate 112, provided with openings 114 therein, is positioned across the inlet opening 92; thereby screening large foreign articles from the incoming water. The water jet unit 6, and particularly the water inlet portion 76, has a horizontally extending wall flange 77 which is engaged by an elastic damper 122 for providing part of the resilient support for the water jet unit 6 within the tunnel 4. The rear end of the hull tunnel 4 by preluding any direct contact therebetween and the area beneath the rear portion of the water jet unit 6 is closed by a further baffle plate 118 that is affixed to the underside of the hull 2 by threaded fasteners 116, as shown in FIG. 6.

The construction of the exhaust system for the watercraft of this invention is like that of copending application for United States Letters Patent entitled, "Exhaust System for Small Planing Boat," in the name of Kazumasa Ito and assigned to the Assignee hereof (Attorney Docket No. 7118-00444), incorporated by reference herein. Generally, exhaust gases are discharged from exhaust ports of the engine 10 into an exhaust manifold (not shown). Cooling water from the engine cooling jacket may also be discharged in an appropriate manner into this exhaust manifold. The exhaust gases and any cooling water then flow through a first exhaust delivery pipe 130 to a first expansion chamber 132 positioned on one side of the engine. The exhaust gases are delivered from the first expansion chamber 132 to a second expansion chamber 134 which, as may be seen in FIG. 2, lies on the opposite side of the engine 10, through a second delivery pipe 136. The second delivery pipe 136 is elastic and has a generally U-shaped section and the second expansion chamber 134 is provided with a water trap arrangement so as to avoid the likelihood that water can flow back into the exhaust ports of the engine through the exhaust system.

An arrangement is provided which permits the use of added silencing devices from those conventionally employed with marine propulsion units and which further insures against the likelihood of water being able to enter the exhaust ports of the engine, even if the watercraft may be inverted and subsequently righted. To this end, an exhaust pipe is provided, indicated generally by the reference numeral 138, which serves to convey exhaust gas and coolant from the second expansion chamber 134 to the body of water in which the watercraft is operating in a submerged location, at exhaust outlet opening 144, and which also incorporates additional silencing and water entry prevention devices.

To avoid the possibility of a high back pressure formation in the exhaust system, when the watercraft is operating at idle or low speeds, there is provided a low speed exhaust gas discharge conduit 140 which extends generally from the highest portion of the exhaust pipe 138 to a discharge opening 142 in the tunnel 4.

To further aid in the silencing of the exhaust gases under all running conditions, and to receive water that may enter the exhaust system through the exhaust outlet opening 144, a further expansion chamber 146 is provided which communicates with the upper portion of the exhaust pipe 138 through a conduit 148.

As may best be seen in FIG. 2, the hull 2 on the sides of the tunnel 4 is filled with bodies of a buoyant material 150 and 152, such as a foamed plastic or the like. This provides added balance for the watercraft to compensate for the weight of the water jet unit 6.

Figure 9:
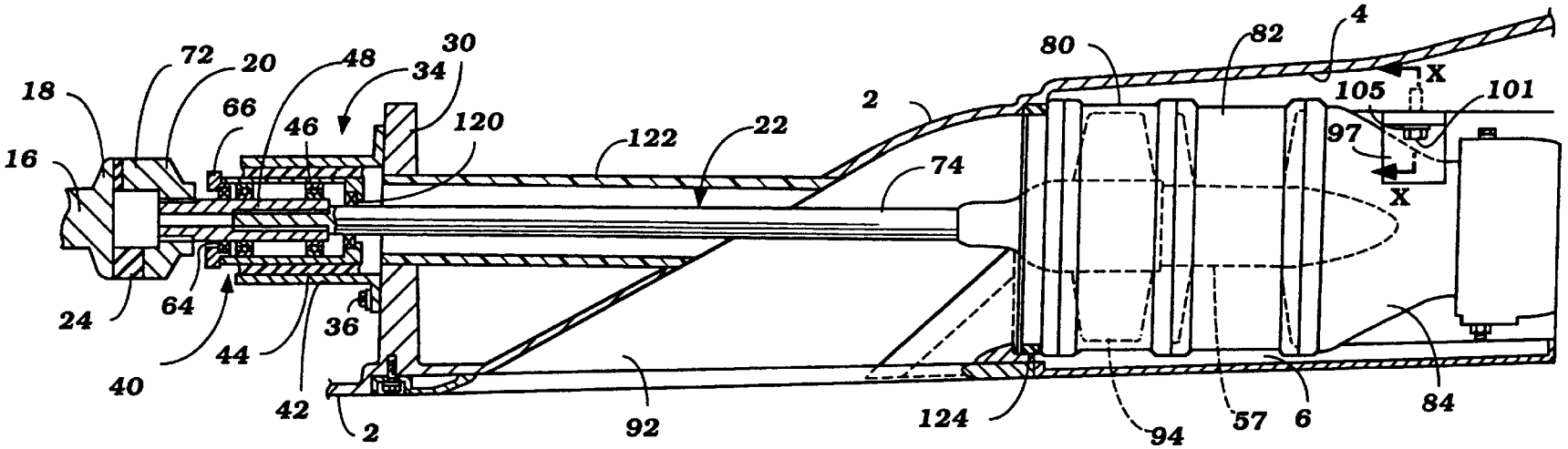
FIG. 9 is a side view, partially broken away, of the mounting structure in accordance with a further embodiment of the invention.

FIG. 9 depicts another embodiment of the invention, likewise providing against vibration transmission between the engine, water jet unit and hull assemblies.

Figure 10:
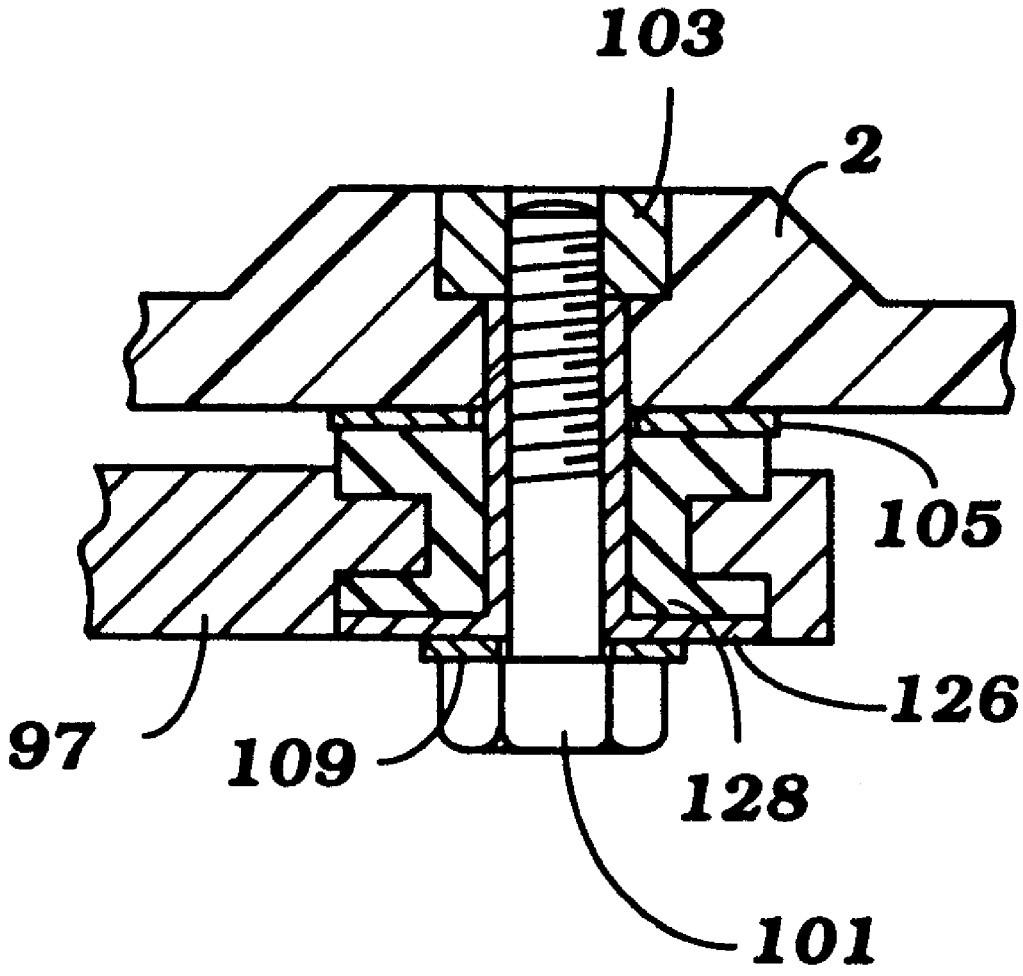
FIG. 10 is a sectional view taken along the line X—X of FIG. 9.

The elastic connection between the engine output shaft 16 and the input coupling member 20 is fashioned in a manner identical to that discussed above. Similarly, much of the bearing carrier 34, and related assemblies, construction is the same as set out above. However, in the embodiment of FIG. 9, a portion of the hull 2 takes the place of the water inlet housing portion 76 of the impeller casing unit, and there is no supporting tube, such as member 52 of FIG. 3, provided around, and along the length of, the power transmitting shaft assembly 22. In FIG. 9, a seal 120 is provided around the impeller shaft at the rearward portion of the bearing carrier 34. From this point, the impeller shaft 74 extends rearwardly through an impeller tube 122 and ultimately into the casing assembly wherein the impeller 94 is located. An O-shaped vibration insulator member 124 encircles a portion of the water jet unit 6 casing member. This vibration insulator 124 prevents the transmission of vibrations between the water jet unit 6 casing and the hull 2 of the watercraft. A further water jet unit 6 casing support is also provided along an upper portion of the rear casing section 84. This vibration dampening support is shown in detail in FIG. 10. It should be readily apparent that the support arrangement depicted in FIG. 10 is quite similar to that of FIG. 8; the difference being that the washer sleeve 126, providing rigid support for the threaded fastener 101, of FIG. 10 extends between the vibration insulator member 128 and up along the shaft of the threaded fastener 101, and ultimately up and into the hull 2 of the watercraft, terminating at a point immediately below the threaded fastener receiver 103, which is additionally mounted within the hull 2. It should be noted that in the arrangement of FIG. 10, the washer sleeve 126 rigidly connects the jet unit 6 and the hull 2 in the horizontal direction, while providing an elastic connection between these two components in the vertical direction. This arrangement provides for convenience in alignment of the jet unit 6 within the hull 2. Thus, the vibration dampening members 124 (FIG. 9) and 128 (FIG. 10), along with the elastic vibration insulating connection between the engine output shaft 16 and the input coupling member 20 (FIG. 9) insure that vibrations in and about the impeller 94, the water jet unit 6 and the power transmitting shaft system 13 are not transmitted to the hull 2 of the watercraft.

Figure 11:
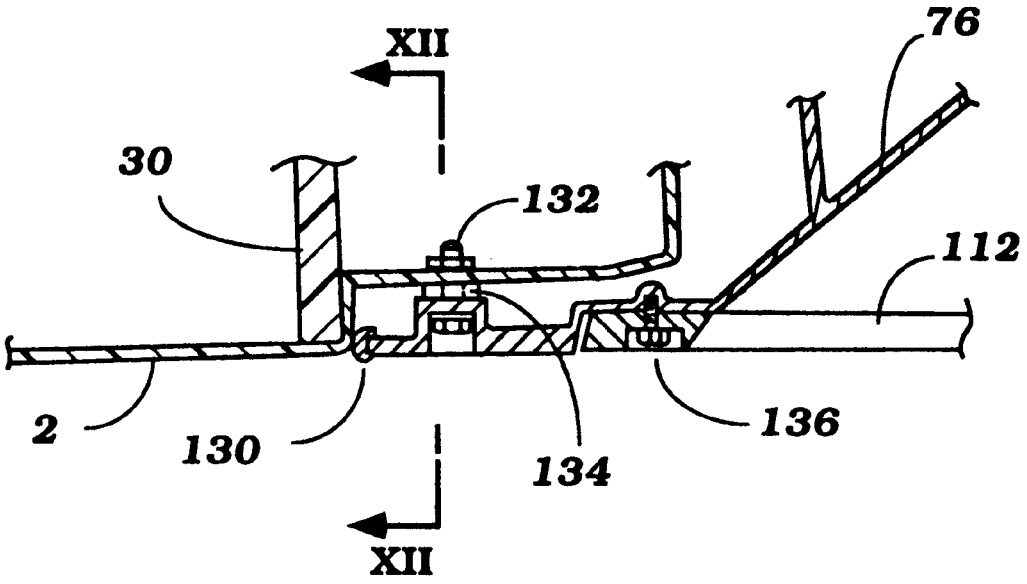
FIG. 11 is a sectional side view showing a further embodiment for a mounting structure in accordance with the invention.
Figure 12:
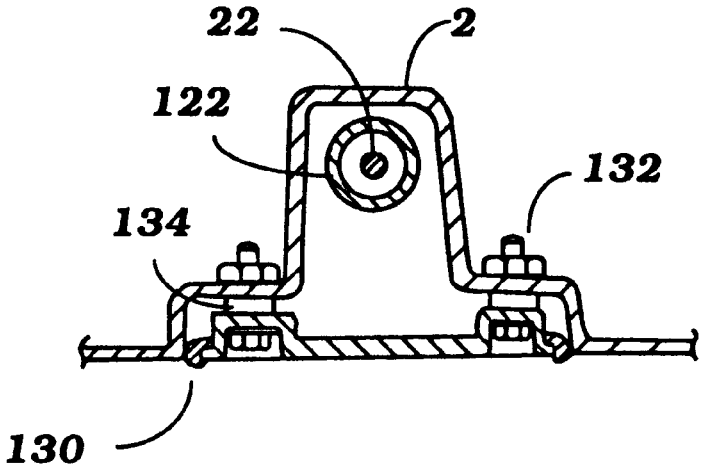
FIG. 12 is a sectional view taken along the line XII—XII of FIG. 11.

Another embodiment providing for vibration isolation between the hull 2 of the watercraft and the water inlet housing portion 76, instead of the elastic damper 122 in FIG. 3, is depicted in FIGS. 11 and 12. The first water inlet housing portion 76 extends downwardly to a point where the hull 2 meets the bulkhead 30, along the underside of the watercraft. A horseshoe-shaped rubber member 130 is fastened to the outer periphery of the lower forwardmost edge or flange of the water inlet housing portion 76 and abuts the hull 2; thereby dampening vibration transmission along this region by preluding any direct contact therebetween. Slightly rearwardly of the rubber member 130, the water inlet housing portion 76 is secured to the hull 2 by way of a threaded fastener 132. A mounting rubber 134 is interposed between the hull 2 and the water inlet housing portion 76 to further prevent vibration transmission between these two members. As illustrated in FIG. 11, the inlet plate 112 may be fastened to the water inlet housing portion 76 at a location rearward of the threaded fastener 132, by any suitable means; such as by threaded fastener 136, as illustrated; or, by a fastener assembly similar to that depicted in FIGS. 9 and 10.

It should be readily apparent that each of the described embodiments provides very good and effective isolation of a watercraft hull from various sources of undesirable vibrations. Although several embodiments of the invention have been illustrated and described, various changes and modifications may be made without departing from the spirit and scope of the invention, as defined by the appended claims.

We claim:

1. A small watercraft having a hull with a tunnel formed in the underside thereof, an engine having an engine output shaft mounted in said hull, a jet propulsion unit comprising an outer housing defining a water inlet passage extending from a water inlet opening surrounded by a flange positioned in juxtaposition at least in part to said hull, an impeller unit containing an impeller and a discharge nozzle, said engine output shaft coupled, via an elastic vibration dampening connection, to an input end of a power transmitting shaft system, for supplying power to said impeller, and a plurality of vibration insulating connector assemblies serving the sole function of mounting said outer housing to said hull within said tunnel including a vibration damper interposed between said outer housing flange and said juxtaposed portion of said hull for precluding any direct contact there between comprising a vibration dampening O-shaped ring member which encircles a portion of said water inlet and contacts said hull.

2. The small watercraft of claim 1 wherein said elastic connection between said engine output shaft and said input end of said power transmitting shaft system comprises a rubber coupling member.

3. The small watercraft of claim 1 wherein said vibration insulating connector assemblies include elastomeric bushings interposed between at least one mounting member of said outer housing and said hull of said watercraft.

4. The small watercraft of claim 3 wherein said vibration insulating connector assemblies interposed between a portion of a mounting leg of said outer housing and a threaded fastener for securing said mounting leg and said vibration insulator member against said hull of said watercraft, so that vibrations incurred by the water jet propulsion unit during operation of the watercraft are not transmitted to said watercraft hull.

5. A small watercraft having a hull with a tunnel formed in the underside thereof, an engine having an engine output shaft mounted in said hull, a jet propulsion unit comprising an outer housing defining a water inlet passage extending from a water inlet opening surrounded by a flange positioned in juxtaposition at least in part to said hull, an impeller unit containing an impeller and a discharge nozzle, said engine output shaft coupled, via an elastic vibration dampening connection, to an input end of a power transmitting shaft system, for supplying power to said impeller, a bearing carrier, having an inner case and an outer case which, together, contain a plurality of anti-friction bearings, said bearing carrier encircling a portion of said power transmitting system at a location wherein an impeller shaft of said power transmitting system is coupled to an input shaft of said power transmitting system and a plurality of vibration insulating connector assemblies serving the sole function of mounting said outer housing to said hull within said tunnel including a vibration damper interposed between said outer housing flange and said juxtaposed portion of said hull for precluding any direct contact there between, elastomeric bushings interposed between at least one mounting member of said outer housing and said hull of said watercraft and a vibration insulator member interposed between a portion of a mounting leg of said outer housing and a threaded fastener for securing said mounting leg and said vibration insulator member against said hull of said watercraft, so that vibrations incurred by the water jet propulsion unit during operation of the watercraft are not transmitted to said watercraft hull.

6. The small watercraft of claim 5 wherein said input shaft of said power transmitting system is secured to an input coupling member of said power transmitting system which, in turn, is connected to said engine output shaft through said elastic vibration dampening connection.

7. The small watercraft of claim 5 wherein the vibration insulating connector assemblies further comprise a vibration insulator member interposed between said bearing unit inner case and said bearing unit outer case.

8. The small watercraft of claim 7 further comprising at least one seal member encircling said input shaft and positioned in close proximity to some of said bearings in said bearing carrier.

9. The small watercraft of claim 8 further comprising a supporting tube surrounding said impeller shaft and extending from an area adjacent to said bearing carrier rearwardly toward said outer housing.

10. The small watercraft of claim 9 further comprising seal members disposed at one end of said supporting tube, near said outer housing, encircling said power transmitting shaft system.

11. The small watercraft of claim 10 further comprising an anti-friction bearing assembly, within said support tube, encircling, and supporting said impeller shaft, and located at a position between said bearing carrier and said seal members.

12. The small watercraft of claim 8 wherein the water inlet comprises a water inlet duct positioned forwardly and downwardly of said impeller and an inlet plate having a plurality of openings covering said inlet duct and forming the outer housing flange.

13. The small watercraft of claim 12 further comprising at least two engine support members positioned between an inner side of said hull and a lower portion of said engine.

14. The small watercraft of claim 13 further comprising a vibration insulator member located between each of said engine support members and said lower portion of said engine.

* * * * *